US008672321B2

(12) United States Patent
Krucinski

(10) Patent No.: US 8,672,321 B2
(45) Date of Patent: Mar. 18, 2014

(54) MEDIA PATH RE-PHASING

(75) Inventor: Martin Krucinski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 31 days.

(21) Appl. No.: 13/024,482

(22) Filed: Feb. 10, 2011

(65) Prior Publication Data

US 2012/0205864 A1 Aug. 16, 2012

(51) Int. Cl.
*B65H 5/34* (2006.01)

(52) U.S. Cl.
USPC ..... 271/270; 271/225; 271/184; 271/279

(58) Field of Classification Search
USPC ..... 271/301, 225, 270, 184; 399/381, 391, 399/383
See application file for complete search history.

(56) References Cited

U.S. PATENT DOCUMENTS

| | | | | |
|---|---|---|---|---|
| 6,374,075 | B1 * | 4/2002 | Benedict et al. | 399/395 |
| 6,973,286 | B2 | 12/2005 | Mandel et al. | |
| 7,024,152 | B2 | 4/2006 | Lofthus et al. | |
| 2009/0257808 | A1 | 10/2009 | Krucinski | |

* cited by examiner

*Primary Examiner* — Luis A Gonzalez
(74) *Attorney, Agent, or Firm* — Hoffmann & Baron, LLP

(57) ABSTRACT

A method of controlling the average sheet velocities in the separate paths in a parallel architecture to prevent sheet collision and provide for sheet arrival in the proper order at the sheet merger point(s) in the media path. Modifying the travel time of the sheets, or re-phasing strategy, at various points along the media path ensure that sheet collision is avoided even at maximum capacity. Adjusting the velocity of the sheets allow for the printer to run at maximum capacity without jamming and collision of the sheets running therethrough.

9 Claims, 3 Drawing Sheets

MEDIA PATH RE-PHASING

TECHNICAL FIELD

The presently disclosed technologies are directed to systems and methods used to improving the average sheet velocity in separate paths in a parallel architecture. The systems and methods described herein provide re-phasing of sheet streams by modifying the velocity profiles in various portions of the media path.

BACKGROUND

The present disclosure relates to digital photocopying and printing on print media sheets and particularly such processes in which the media sheets are fed serially from at least one tray or feeder and may traverse any of several chosen paths through one or a multiplicity of marking engines. In such photocopying and printing, the media sheets typically pass through a myriad of nip rollers and gates where the transport speed may be varied and the sheets are directed around numerous bends and the sheets may also be inverted for duplex printing or printing on both sides of the media sheet.

Heretofore, in digital photocopying/printing and particularly with electrostatic photocopiers, the media sheet path is chosen by the electronic programmer once the user has inputted the print job requirements. The sheets are fed and transported through the marking engine(s) with occasional or very limited sheet position readings by sensors located along the sheet path for providing a basis for correcting the timing of the media sheet feed into the marking engine(s) and the progress of the media sheets through the marking engine(s). The progression of media sheets through the marking engine(s) has thus essentially been accomplished by open loop control.

Where media sheets progress through a complicated transport path of multiple nip rollers, bends, and gates, variations in the path length due to varying properties of the print sheet media such as varying length, variations in the velocity on the surface of the nip rollers, variations in the bends through which the sheet traverses have allowed sheet positioning errors to compound thereby resulting in collisions, mis-registrations and jamming. Problems of this sort have been particularly acute in arrangements where large documents are to be printed at high speed in parallel paths through multiple marking engines. The combination of high sheet velocity and extended complex sheet paths are intolerant of substantial variations in the timing of the sheet position along the path in order to prevent collisions, mis-registration and jamming.

Thus, it has been desired to provide a way or means of improving the media sheet control and transport through marking engines in digital printing in a manner which eliminates or minimizes mis-registration and jamming.

SUMMARY

According to aspects described herein, there is disclosed a method of controlling print sheet media traverse through complex or multiple paths in a parallel architecture. The progression of the sheets through the path established by the electronic controller, for the particular user requested print job, provides for each of the nip rollers to be driven by individual variable speed motors; and, sheet position sensors are disposed at each of the bends and gates in the path to provide information to the controller upon the arrival of a sheet at that sensor station. The controller then applies a correction algorithm to generate a control signal for the motor drive of the proximate nip rollers to correct for any errors in the sheet velocity with respect to the planned program through the chosen media path in order to prevent mis-registration and jamming. Thus, the individual variable speed drive to each of the nip rollers enables the controller to adjust the speed of the sheets to prevent jamming or colliding of multiple sheets within the system.

Further, a method of controlling the average print media velocity in separate print paths in a parallel architecture printer system for re-phasing the media is disclosed. The method includes providing a parallel architecture printer including a feeder path, a finisher path and an imaging path therebetween, the imaging path branches into at least two separate print paths, the imaging path merges into a single print path at the finisher path. Each print path includes nip rollers disposing more than one print media into the feeder path; directing the more than one print media through the feeder path into each of the print paths in a predetermined order; driving the more than one print media into each of the nip rollers; adjusting the velocity of each of the nip rollers to modify travel timing through the imaging path to prevent paper jamming and collision of the more than one print media throughout the parallel architecture printer; imaging the more than one print media in each of the imaging paths; and merging the more than one print media into the finisher path in the predetermined order.

Additionally, a system is disclosed for controlling the average print media velocity in separate print paths in a parallel architecture printer engine. The system includes a media sheet feeder disposed proximate the print engine and operative for timed feeding of sheets thereto. At least two imaging paths extend through the printer engine and plurality of nip rollers in the engine disposed along each of the imaging paths for defining and directing the sheets through the printer engine. A split point between the media sheet feeder and the at least two imaging paths directs the media sheet into one of the at least two imagining paths. A nip controller drives the sheets into each of the nip rollers and adjusts the velocity of each of the nip rollers to modify travel timing through the imaging path to prevent paper jamming and collision of the sheets throughout the engine. An imaging device in each of the imaging paths images the sheets. A merge point between the at least two imaging paths and a finisher combines the at least two imaging paths into a single finishing path for driving the sheets to the finisher, where the sheets enter the merge point in a predetermined order as controlled by the nip rollers.

Furthermore, a method is disclosed for controlling average print media velocity in a parallel digital printing. The method includes providing a digital print engine with a plurality of media sheet nip rollers defining at least two sheet paths within the print engine, wherein the sheet paths are in parallel; disposing at least one print media sheet feeder proximate the print engine; driving each of the nip rollers individually with a variable speed motor and propelling the print media through the at least one path; sensing the position of each media sheet in the path and providing a sheet positioning signal indicative of the velocity of the sheet at a known time; mapping the sensed media sheet positions; generating a speed control signal for each motor based upon the sensed media sheet position; and driving each motor at the speed to position the sheet on the selected path at a desired position to modify travel timing of the sheet through the imaging path to prevent paper jamming and collision of the print media at a merge point of the at least two sheet paths.

These and other aspects, objectives, features, and advantages of the disclosed technologies will become apparent from the following detailed description of illustrative embodiments thereof, which is to be read in connection with the accompanying drawings.

DETAILED DESCRIPTION

The method and system disclosed herein provide for improving the control of average sheet velocity in separate paths in a parallel architecture.

As used herein, the phrase "print making device" encompasses any apparatus, such as a digital copier, a bookmaking machine, a facsimile machine, and a multi-function machine, which performs a printing outputting function for any purpose. Examples of marking technologies include xerographic, inkjet, and offset marking.

As used herein, the phrase "sheet conveying device" encompasses any apparatus, such as a digital copier, a bookmaking machine, a facsimile machine, and a multi-function machine, which performs an outputting function for any purpose. The sheet conveying device includes printing and non-printing devices. Examples of marking technologies include xerographic, inkjet, and offset marking.

As used herein, the phrase "sheet" encompasses, for example, one or more of a usually flimsy physical sheet of paper, heavy media paper, coated papers, transparencies, parchment, film, fabric, plastic, or other suitable physical print media substrate on which information can be reproduced.

As used herein, the phrase "path" or "pathway" encompasses any apparatus for separating and/or conveying one or more sheets into a substrate conveyance path inside a printing device.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as referred to herein can include one or more point sensors and/or array sensors for detecting and/or measuring characteristics of a substrate media, such as speed, orientation, process or cross-process position and even the size of the substrate media. Thus, reference herein to a "sensor" may include more than one sensor.

As used herein, "travel timing" refers to multiple travel times at different parts of the path which contributes to the overall travel time of the system.

As used herein, "re-phasing" refers to modifying travel times throughout the system by modifying velocity profiles in various portions of the media path to prevent jamming, collision at merge points and provide efficiency and speed through the system.

Figure 1:
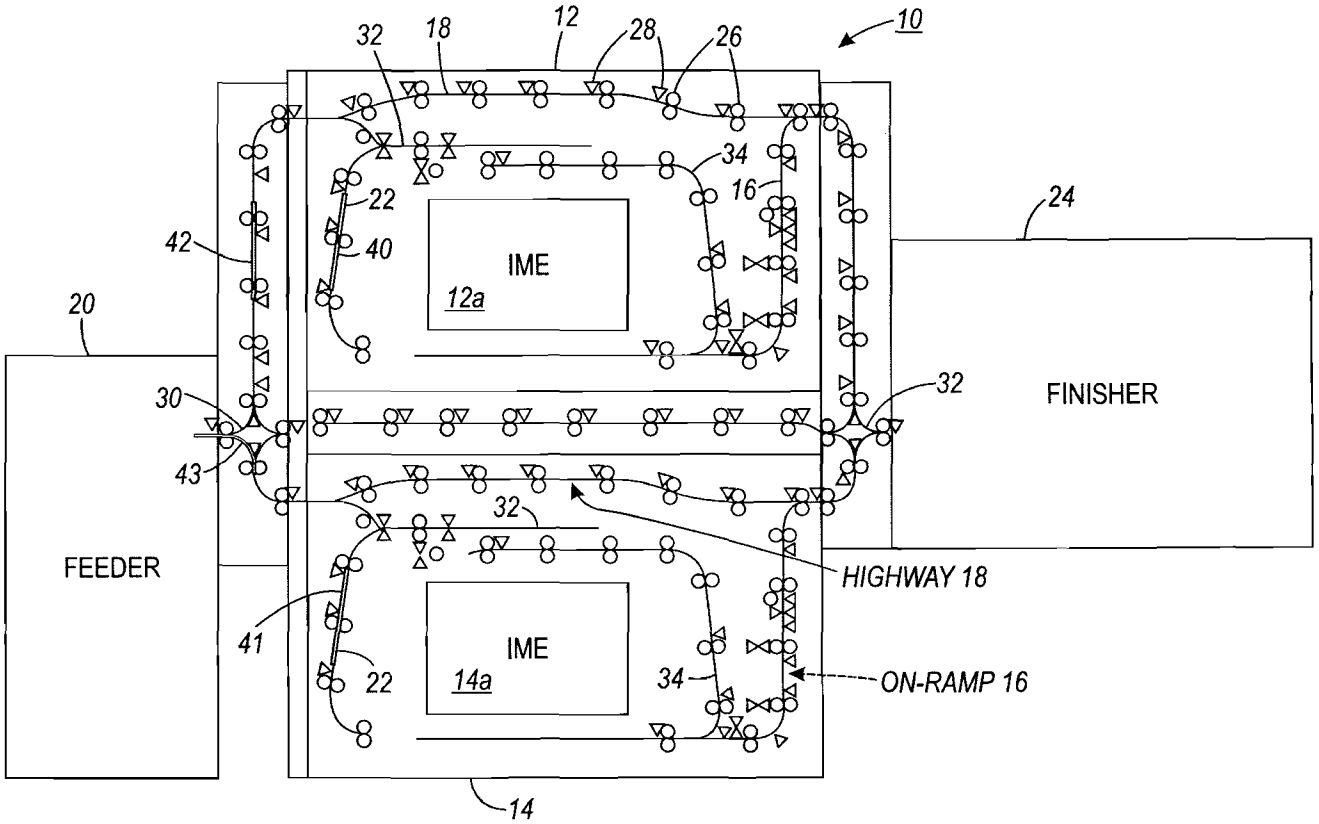
FIG. 1 is a pictorial schematic of a single tower tightly integrated parallel printing machine illustrating a complex media path in accordance with an aspect of the disclosed technologies.

Referring to FIG. 1, an arrangement for a photocopier/printer is indicated generally at 10 includes a plurality of image marking engines (IME) 12, 14 arranged to receive media sheets from at least one feeder 20 and to output printed sheets to a finisher as indicated generally at 24. It will be understood that each of the marking engines includes various processing paths and inter-engine transport paths for accomplishing the desired marking on the print media sheets as for example, single or duplex printing, and thus may require sheet inverters as is known in the art of digital printing.

Each of the marking engines 12, 14 have intermediate paths therein determined by a plurality of pairs of nip rollers 26 and sensors 28 located therealong for defining and monitoring the movement of sheet media along a given path determined by the controller for the print job as will hereinafter be described in greater detail.

A media path controller includes sheet controllers and nip selector, nip controller, sheet reference trajectory generators, and sheet observer. Each pair of nip rollers 26 is driven by an individual motor and connected to a nip controller. The nip controllers provide a voltage signal to the nip roller motors along the paper path. The sensors provide nip velocity output signals and sheet present sensor signals to the input of the trajectory generators and the sheet observer. The sheet reference trajectory generators also receive input instructions from the path planner controller based upon user inputs for the printing job.

The sheet reference trajectory generators provide an output to the sheet controllers of the reference sheet positions and an output of the reference sheet velocities to the sheet controllers.

The sheet reference trajectory generators generate the desired sheet trajectories including the positions and velocities and for each sheet that enters the system using information from the planner. The reference trajectories are designed to provide desired velocity matching between the various locations in the media path such as for the on-ramp 16, highway 18 and off-ramp 22 locations wherein the on-ramp 16 trajectories start at printer exit velocity and end at the highway 18 velocity.

FIG. 1 shows the overview of a single tower eTIPP media path 10. A single tower eTIPP media path 10, such as a Rack Mounted Printing prototypes (RMP) printing a print job in tightly integrated parallel printing mode (TIPP mode), utilizing both the upper and lower image IMEs. Sheet 1 is printed in the upper IME 12, and its travel time through the system, from the split point 30 after the feeder to the merge point 32 before the finisher, is t1. Sheet 2 is printed in the lower IME 14, and its travel time through the system, is t2. The arrival time difference between the sheets at the merge point 32 just before the finisher is $\Delta t = t1 - t2$.

In accordance with an aspect of the disclosed technologies, a re-phasing strategy for multi-engine media paths includes one or multiple split points 30 before Image Marking Engines (IMEs) 12,14, one or multiple merge points 32 after IMEs 12,14 and operation of the media path at full capacity regardless of sheet routings by adjusting path travel times in order to avoid collisions at merge points.

The feeder 20 is feeding out sheets every Tf [s], i.e. at a capacity of 60/Tf [ppm] and that this capacity equals the maximum TIPP system printing capacity as well as the maximum highway 18 capacity, 60/TH [ppm] (where TH [s] is the highway pitch time). In steady state TIPP operation, every other sheet fed from the feeder 20 will be printed in the upper IME 12 and every other sheet fed from the feeder 20 will be printed in the lower IME 14. For the printed sheet streams to merge successfully at the merge point 32 before the finisher 24, they have to interleave without colliding, i.e. Δt=2 TH Q, where Q is an arbitrary integer. The difference in travel time between upper & lower path has to be a multiple of double the highway sheet pitch time.

For example, if the arbitrary integer Q=0, the first sheet 40 in the upper path 12, second sheet 41 in the lower path 14, third sheet 42 in the upper path 12, fourth sheet 43 in the lower path 14, etc., will merge as first sheet 40, second sheet 41, third sheet 42, fourth sheet 43, etc. at the merge point 32. In another example, arbitrary integer Q=2, the upper path 12 takes longer by a factor of 4 (4 TH [s] longer), the sheet stream fed from the feeder 20 as first sheet 40, second sheet 41, third sheet 42, fourth sheet 43, etc. will merge at the merge point 32 as second sheet 41, empty pitch (E), fourth sheet 43, empty pitch (E), first sheet 40, sixth sheet (not shown), third sheet 42, etc. In this scenario, the planner would need to consider the longer path of the upper path 12 and schedule the imaging accordingly to verify the accuracy of the imaging and prevent collision or jamming. The planner would schedule the images to be printed as: Image 1 on second sheet 41 fed, Image 2 on fourth sheet 43 fed, image 3 on first sheet 40 fed, image 4 on sixth sheet fed, image 5 on third sheet 42 fed, etc. in order to print the job correctly.

Further, assume that the media path geometries are such that the arrival time difference at the merge point 32 just before the finisher 24 is not Δt=2 TH Q. This will lead to sheets colliding at the merge point 32. Collisions in this context are defined as sheets having an inter-sheet spacing (ISS) of less than the minimum allowed highway sheet spacing (ds), $$ds = v\text{highway} * \text{TH} - \text{L}$$

where L is the sheet length.

The only way in which the planner can avoid collisions in this scenario is to modify the feed times of sheets. If the system combined printing capacity requires the feeder 20 to feed as fast as possible, the only option is to delay the feeding of sheets so that the merging can take place without collisions. This will effectively lower the maximum productivity of the TIPP system which is un-desirable.

Therefore, in accordance with an aspect of the disclosed technologies, the sheets are re-phased as they pass through various media path portions in such a way that the arrival time differences between split point(s) 30 and merge point(s) 32 fulfill the required 2 TH Q [s]. In doing so, sheet streams can always be split and re-merged at full productivity without collisions. In accordance with an aspect of the disclosed technologies, several methods of controlling the re-phasing of the sheets are disclosed including re-phasing at the highway 18, re-phasing at the on-ramp 16 and/or re-phasing at the off-ramp 22. The re-phasing can be utilized as rules for media path design.

During the design of the media path, path lengths, nominal velocities, acceleration and deceleration zones and nip groupings can be guided by these re-phasing conditions. The design strategy for TIPP media paths of the disclosed technologies, includes rules for media path travel times, which in turn guides the design of path lengths, velocities, acceleration/deceleration zones, that will allow operation at full capacity without having to re-phase sheets in certain paths. For example, re-phasing in the highways, can increase cost since it may require additional motors and sections, nips with a common drive motor, in order to speed up or slow down sheets.

Modifying existing systems is contemplated as well. The re-phasing strategy of the disclosed technologies provides for heterogeneous, multi-engine media paths, with the image marking engines operating at different productivities and at different entry and exit velocities without jamming and/or collision of sheets. The re-phasing can also be used for feeder scheduling. The feeder scheduling strategy based on the re-phasing conditions of the disclosed technologies avoids collision further downstream in media paths, useful for scheduling algorithms. The current constraint based routing/scheduling places feed times in the windows allowed by the re-phasing conditions. This may involve operating the feeder at less than the maximum eTIPP system capacity. In the case of existing systems, the re-phasing conditions can be incorporated into the scheduling algorithms.

Figure 2:
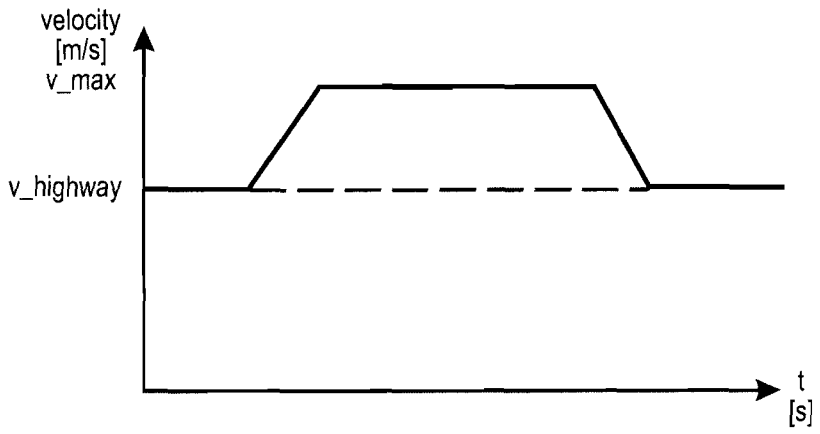
FIG. 2 is a graph of a velocity control through the highway of the media path as a function of time in accordance with an aspect of the disclosed technologies.

FIG. 2 is a graph of the velocity through the highway 18 over time. FIG. 2 shows adjusting the velocity of a sheet through the highway 18(*v*_highway), or highway re-phasing. The v_highway is the nominal highway velocity. As sheets travel through the highways 18, the speed of the sheet is controlled by speeding up and then slowing down sheets by the nips 26, in order to modify the travel time. By first speeding up and then subsequently slowing down, sheet collisions during these velocity changes are avoided. Adjusting the velocity through the highway 18 allows for continuous feed and continuous operation of the machine.

Figure 3:
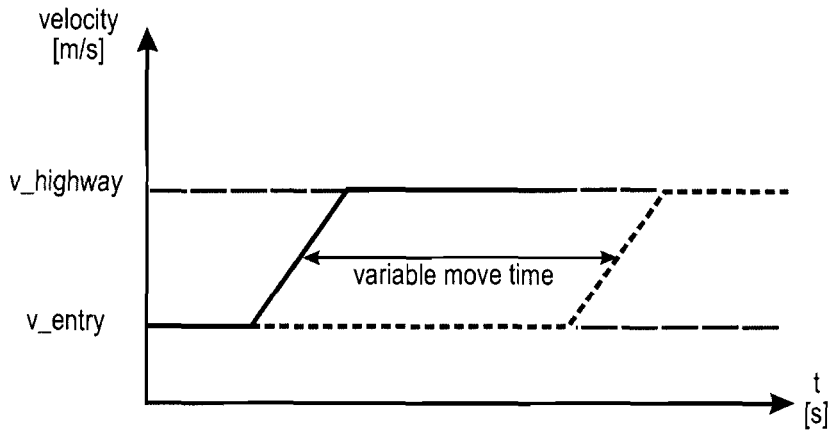
FIG. 3 is a graph of a velocity control through the on-ramp of the media path as a function of time in accordance with an aspect of the disclosed technologies.

FIG. 3 is a graph of the velocity through the on-ramp 16 over time, on-ramp re-phasing. The v-exit is the IME exit velocity. As sheets travel through the on-ramps 16, from IMEs 12*a*, 14*a* to highways 18, velocity profiles that control the speed-up (acceleration used and/or acceleration starting time) from IME 12 exit velocity to highway 18 velocity allow for re-phasing by varying the time at low velocity vs. highway velocity. The velocities higher than v_highway would allow larger variations in on-ramp 16 move times to facilitate re-phasing.

Figure 4:
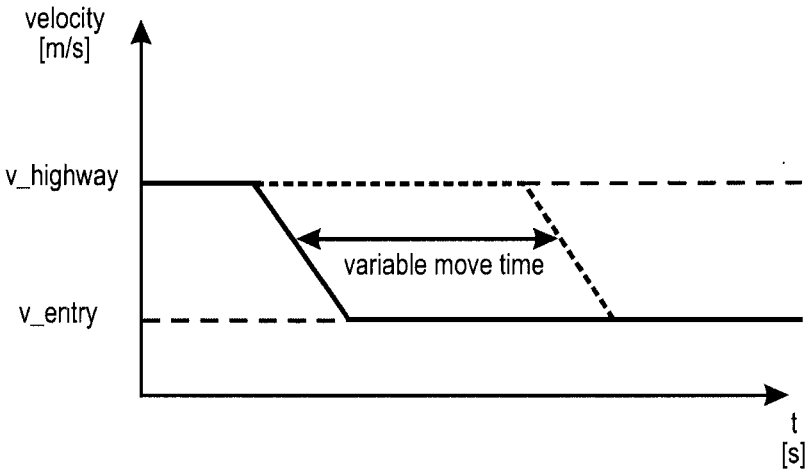
FIG. 4 is a graph of a velocity control through the off-ramp of the media path as a function of time in accordance with an aspect of the disclosed technologies.

FIG. 4 is a graph of the velocity through the off-ramp 16 over time, off-ramp re-phasing. The v_entry is the IME entry velocity. is the As sheets travel through the off-ramps 22, from highways 18 to IMEs 12*a*,14*a* or other low-velocity modules (e.g. sensor modules), these velocity profiles allow for re-phasing by controlling the time at low velocity vs. highway velocity. Additional modifications to the velocity profiles, such as stopping & dwelling in the off-ramp (i.e. using velocities lower than v_exit) and/or using velocities higher than v_highway would allow larger variations in off-ramp move times to further facilitate re-phasing.

Additionally, on-ramp rephrasing with inversion is contemplated. Devices with front end inverters 34 are used in on-ramps 22, inverter velocity profiles can be controlled to modify the move times. Similarly, devices with back end inverters 34 used in off-ramps 16, inverter velocity profiles can be controlled to modify the move times.

Further, adjusting the velocity of a sheet using a combination of on-ramp, off-ramp, highway and inverters velocity adjustments, allows for continuous feed and operation without jamming at the merge points. All media path portions transporting a given sheet from a split point 30 to a merge point 32 can be used to re-phase the sheet by small amounts. The total sum of these re-phasing amounts throughout the media path is important and is controlled to fulfill the no collision condition Δt=2 TH Q [s] and achieve full productivity regardless of sheet routings in a given print job.

Further, whenever the system operates at a lower capacity than the maximum highway capacity, the no collision condition is able to adjust. The average inter-sheet spacing when splitting and merging is now larger than the spacing at maximum capacity. The difference in travel time between upper path 12 and the lower path 14 is required to be in a range around the multiple of double the highway sheet pitch time requirement, offset by the split point time difference between odd and even sheet pitches. The no collision condition at merging changes to:

$$TH,max+2\ TH\ Q-t\text{even@split} \geq \Delta t \geq 2\ TH\ (Q+1)-TH,\ max-t\text{even@split}\ [s],$$

where teven@split is the time between an odd sheet leading edge to an even sheet leading edge and TH,max is the highway pitch time at maximum capacity.

It will be appreciated that various of the above-disclosed and other features and functions, or alternatives thereof, may be desirably combined into many other different systems or applications. It will also be appreciated that various presently unforeseen or unanticipated alternatives, modifications, variations, or improvements therein may be subsequently made by those skilled in the art which are also intended to be encompassed by the disclosed embodiments and the following claims.

What is claimed is:

1. A system for controlling print media velocity in separate print paths in a parallel architecture printer engine comprising:

a) a media sheet feeder disposed proximate the printer engine and operative for timed feeding of sheets therefrom at a constant rate;

(b) at least two imaging paths, each of the imaging paths including a highway by-passing an image marking engine associated with the imaging path, an on-ramp located between the associated imaging marking engine and the highway, an off-ramp located between the highway and the associated imaging marking engine, and a plurality of nip rollers disposed along the on-ramp, off-ramp, and highway of each of the imaging paths for defining and directing movement of the sheets through the printer engine;

(c) a split point between the media sheet feeder and the at least two imaging paths to direct the sheets into one of the at least two imaging paths;

(d) a controller configured to control the nip rollers;

(e) the imaging marking engine associated with each of the imaging paths for marking the sheets;

(f) a merge point between the at least two imaging paths and a finisher to combine the at least two imaging paths into a single finishing path for driving the sheets to the finisher, wherein the controller is configured to re-phase movement of the sheets from the split point to the merge point, including:

determining and summing velocity adjustments for movement of each of the sheets along the on-ramp, off-ramp, and highway of each of the imaging paths, in order that the sum of the velocity adjustments for each sheet moving through each of the imaging paths satisfies a non-collision condition so that the sheets enter the merge point in a predetermined order without collision.

2. The system of claim 1 wherein the controller adjusts velocity of the sheets through the off-ramp of each of the at least two imaging paths by controlling the nip rollers located along the off-ramp.

3. The system of claim 2 wherein the controller adjusts velocity of the sheets through the on-ramp of each of the at least two imaging paths by controlling the nip rollers located along the on-ramp.

4. The system of claim 3 wherein the controller adjusts velocity of the sheets through the highway of each of the at least two imaging paths by controlling the nip rollers located along the highway.

5. The system of claim 1 wherein the controller adjusts velocity of the sheets through the on-ramp of each of the at least two imaging paths by controlling the nip rollers located along the on-ramp.

6. The system of claim 1 wherein the controller adjusts velocity of the sheets through the highway of each of the at least two imaging paths by controlling the nip rollers located along the highway.

7. The system of claim 1 wherein the velocity adjustments are in accordance with a velocity profile that includes at least one predetermined increase or decrease in the velocity of the sheet along at least one of the on-ramp, off-ramp, and highway, and predetermined timing of the at least one increase or decrease.

8. The system of claim 1 wherein the on-ramp of one of the imaging paths includes an inverter that inverts the sheets for duplex printing, the inverter having associated nip rollers for moving the sheets through the inverter, wherein the controller further re-phases movement of the sheets from the split point to the merge point by determining a velocity adjustment for movement of the sheets that move along the inverter.

9. The system of claim 1 wherein the non-collision condition is satisfied when the printer engine operates at a maximum capacity and when the printer engine operates at a less than maximum capacity, wherein the maximum capacity includes at least one of maximum printing capacity, maximum feeder capacity, and maximum highway capacity.

* * * * *